US006575123B2

(12) United States Patent
Negishi et al.

(10) Patent No.: US 6,575,123 B2
(45) Date of Patent: Jun. 10, 2003

(54) COOLING SYSTEM OF MULTICYLINDER ENGINE

(75) Inventors: Hideo Negishi, Hino (JP); Shinichi Sasaki, Hino (JP)

(73) Assignee: Hino Motors, Ltd., Hino (JP)

( * ) Notice: Subject to any disclaimer, the term of this patent is extended or adjusted under 35 U.S.C. 154(b) by 0 days.

(21) Appl. No.: 09/953,866

(22) Filed: Sep. 18, 2001

(65) Prior Publication Data

US 2002/0033147 A1 Mar. 21, 2002

(30) Foreign Application Priority Data

Sep. 19, 2000 (JP) ..... 2000-282902

(51) Int. Cl.[7] ..... F02F 7/00
(52) U.S. Cl. ..... 123/41.42; 123/41.33
(58) Field of Search ..... 123/41.42, 41.33, 123/41.35

(56) References Cited

U.S. PATENT DOCUMENTS 5,190,003 A * 3/1993 Voigt ..... 123/195 R
5,522,351 A * 6/1996 Hudson ..... 123/41.33

OTHER PUBLICATIONS

U.S. application Ser. No. 09/953,866, filed Sep. 18, 2001, pending, Docket No. 214061US3 Present application; listed for imformation.

U.S. application Ser. No. 09/953,867, filed Sep. 18, 2001, pending, Docket No. 214065US3.

* cited by examiner

*Primary Examiner*—Thomas N. Moulis
(74) *Attorney, Agent, or Firm*—Oblon, Spivak, McClelland, Maier & Neustadt, P.C.

(57) ABSTRACT

Formed in a cylinder block of a multi-cylinder engine are oil grooves each arranged in a top deck of the cylinder block to surround a corresponding cylinder liner, a supply channel connected to an oil pump, a return channel connected to an oil pan, communication holes interconnecting adjacent oil grooves in series, an inflow hole connecting the most upstream oil groove to the supply channel and an outflow hole connecting the most downstream oil groove to the return channel. Consequently, the oil grooves of all cylinders connected in series cause engine oil to flow through all the oil grooves at the same rate. Such an arrangement is simple in structure and has reduced the number of components so that the manufacturing cost is reduced and the reliability of the cooling system is enhanced.

1 Claim, 2 Drawing Sheets

COOLING SYSTEM OF MULTICYLINDER ENGINE

BACKGROUND OF THE INVENTION

1. Field of the Invention

This invention relates to a cooling system of a multi-cylinder engine. More particularly, it relates to a cooling system simple in structure and capable of attaining an improved cooling effect on the tops of cylinder liners each of which receives heat transmitted from a corresponding top ring on a corresponding piston.

2. Detailed Description of the Related Art

In a multi-cylinder engine, a water jacket in a cylinder block cannot extend to a top deck of the block from the viewpoint of structural strength. However, at the very top deck, each cylinder liner on the block will receive a great amount of heat transmitted from a corresponding top ring on a corresponding piston when the latter is near and at its top dead center position. Therefore, it has been proposed in recent years that an oil groove be formed on the top deck of the cylinder block to surround the corresponding cylinder liner and that some of the engine oil from a main oil gallery (not shown) is circulated through the oil grooves, to thereby suppress any temperature rise of each of the cylinder liners due to the heat transmitted from the corresponding top ring on the corresponding piston when the latter is near and at its top dead center position.

However, in the conventional system, the oil grooves are respectively connected to the main oil gallery through oil pipes arranged outside the cylinder block so as to equalize the cooling performance of the respective oil grooves. Such an arrangement requires complex machining and installation and an increase in the number of parts because of the external piping. Moreover, there is a risk that oil may leak from joints along the piping.

In view of the above, it is an object of the present invention to provide a cooling system which is simple in structure and which can effectively cool a top of each cylinder liner and its neighboring area.

BRIEF SUMMARY OF THE INVENTION

In order to attain the above-mentioned object, the invention provides a cooling system of a multicylinder engine, which comprises oil grooves each arranged in a top deck of a cylinder block to surround a corresponding cylinder liner, supply and return channels in the cylinder block and connected to an oil pump and an oil pan, respectively, communication holes each for interconnecting the adjacent oil grooves in series and inflow and outflow holes in the cylinder block for connecting the most upstream and downstream oil grooves to the supply and return channels, respectively, thereby circulating engine oil through the oil grooves during an operation of the engine to effectively cool a top of each cylinder liner and a neighboring area thereof.

A preferred embodiment of the invention will be described with reference to the drawings.

DESCRIPTION OF THE PREFERRED EMBODIMENTS

Figure 1:
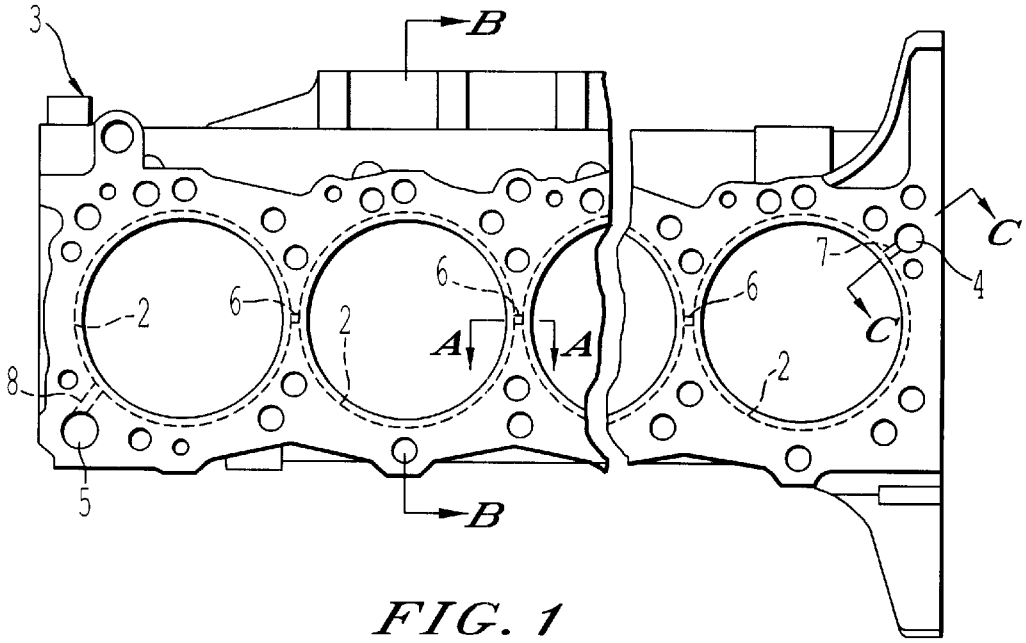
FIG. 1 is a plan view of a cylinder block of an embodiment of a cooling system according to the invention.
Figure 2:
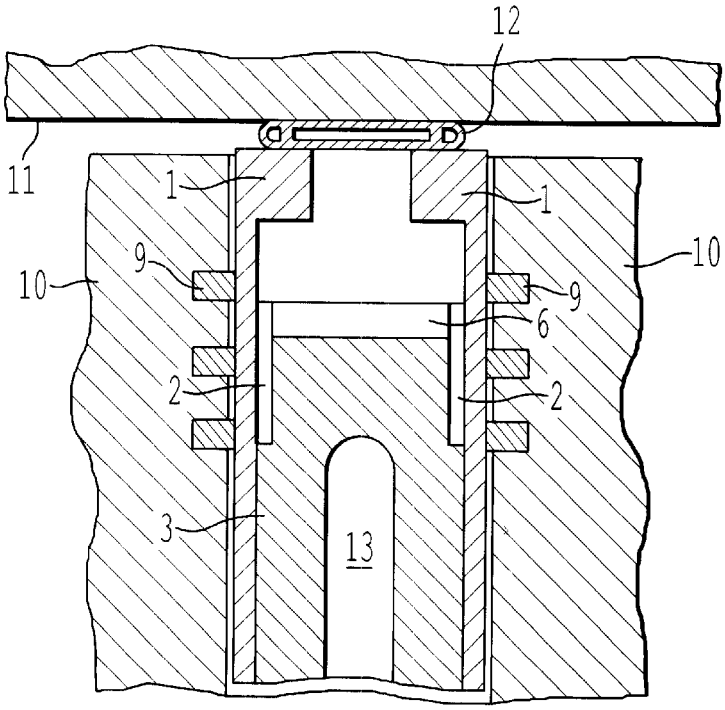
FIG. 2 is an enlarged sectional view taken along line A—A in FIG. 1.
Figure 3:
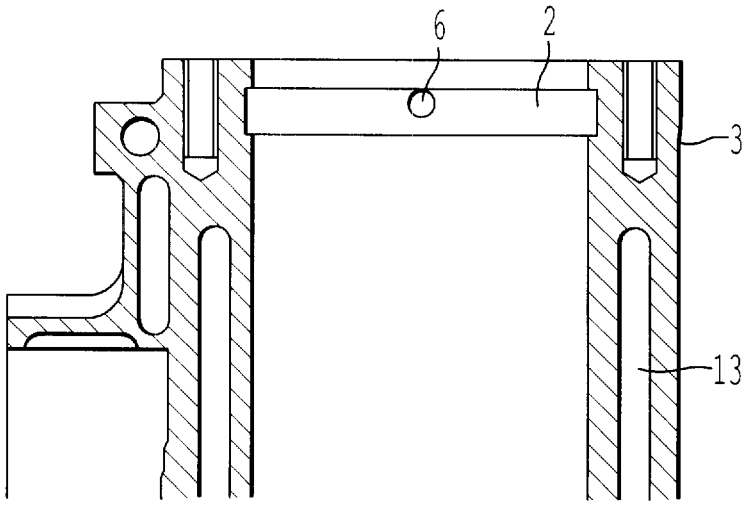
FIG. 3 is an enlarged sectional view taken along line B—B in FIG. 1.
Figure 4:
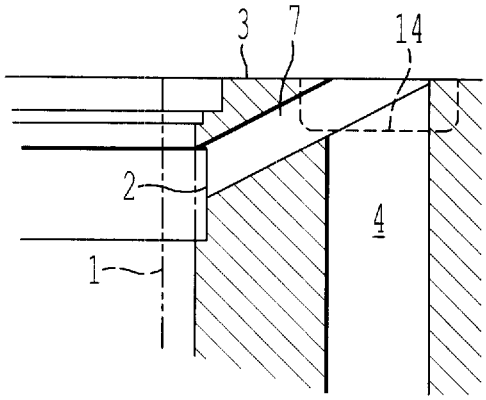
FIG. 4 is an enlarged sectional view taken along line c—c in FIG. 1.

Referring to FIGS. 1 through 4, each of oil grooves 2 is formed on a top deck of a cylinder block 3 in a multi-cylinder engine to surround a corresponding cylinder liner 1. A supply channel 4 is provided in the cylinder block at one end for feeding engine oil from an oil pump to an oil channel (not shown) of a cylinder head 11 at the same end. Also, a return channel 5 for returning the engine oil in the cylinder head 11 to an oil pan (not shown) is provided in the cylinder block at the opposite end.

The cylinder block 3 is provided with communication holes 6 each interconnecting the adjacent oil grooves 2, resulting in connection of all the grooves 2 in series. The block 3 is further provided with inflow and outflow holes 7 and 8 through which the most upstream and downstream grooves 2 are connected to the supply and return channels 4 and 5, respectively. Thus, some of the engine oil flowing through the supply channel 4 flows through the inflow hole 7 into the oil groove 2 and then sequentially into the respective oil grooves 2 before it flows through the outflow hole 8 into the return channel 5 and return to the oil pan. In this manner, the oil cools the top of each of the cylinder liners 1 and its neighboring area.

In this specification, the top of the cylinder liner 1 refers to a portion of the cylinder liner 1 in contact with a corresponding top ring 9 on a corresponding piston 10 when the latter is near and at its top dead center position. Therefore, any temperature rise of the top of each cylinder liner 1 to which heat is transmitted from the top ring 9 on the piston 10 when the latter is near and at Its top dead center position, is suppressed by the cooling effect of the engine oil flowing through the oil grooves 2.

In the drawings, reference numerals 12 and 13 denote a head gasket and a water jacket, respectively. Although not necessary, a spot facing 14 may be formed at a top portion of the supply channel 4 connecting the latter to the inflow hole 7 and/or at a top portion of the return channel 5 connecting the latter to the outflow hole 8, as indicated by a broken line in FIG. 4. The spot facing 14 facilitates the operation of machining the inflow hole 7 (the outflow hole 8) and secures the connection between the Inflow hole 7 (the outflow hole 8) and the supply channel 4 (the return channel 5).

Figure 5:
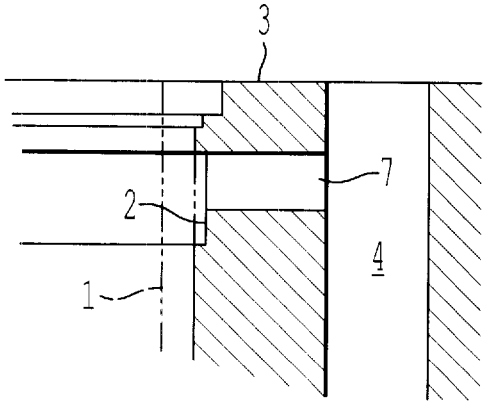
FIG. 5 is a sectional view similar to FIG. 4 showing a modification of an inflow or outflow hole of FIG. 4.

In the above embodiment, the inflow hole 7 (the outflow hole 8) is inclined so as to gradually rise from the most upstream (downstream) oil groove 2 to reach the top of the supply channel 4 (the return channel 5) so that the inflow hole 7 (the outflow hole 8) can be bored from a top surface of the cylinder block 3. However, for the purposes of the present invention, the inflow and outflow holes 7 and 8 do not necessarily have to be inclined. Alternatively, the inflow hole 7 (the outflow hole 8) may be made to extend horizontally from the oil groove 2 to reach the supply channel 4 (the return channel.5), as shown in FIG. 5. In short, it is sufficient for the inflow hole 7 to guide some of the engine oil flowing through the supply channel 4 into the most upstream oil groove 2 and for the outflow hole 8 to guide the engine oil flowing in the most downstream oil groove 2 into the return channel 5. Thus, the configurations of the inflow and outflow holes 7 and 8 are not limited to those of this embodiment.

Thus, according to the invention, the cylinder block 3 is provided in the top deck thereof with the communication holes 6 each interconnecting the adjacent oil grooves 2 in series, the inflow and outflow holes 7 and 8 formed in the block 3 connecting the most upstream and downstream grooves 2 to the supply and return channels 4 and 5 formed in the block 3 at the one and opposite ends, respectively. Such connection of the oil grooves 2 in series allows the oil to flow through each of the oil grooves 2 at the same rate. Therefore, it is no longer necessary to provide distribution means such as external piping unlike conventional cooling systems.

It will be appreciated that the temperature of the engine oil flowing through the oil grooves 2 rises as the cooling operation proceeds. Therefore, the temperature of the oil flowing through the downstream groove 2 will become higher than that of the oil flowing through the upstream groove 2. Consequently, there is gradual reduction in capacity of cooling the cylinder liners 1 as the engine oil flows through the oil grooves 2 in series. Thus, while it is not possible to cool all the cylinder liners 1 with the same cooling capacity, the disparity in the cooling capacity may be minimized so as not to give rise to any operational problems. This is done by making the engine oil flow through all the oil grooves 2 at a predetermined rate or higher.

Therefore, it is no longer necessary to evenly distribute engine oil to the oil grooves by arranging oil pipes outside the cylinder block. As a result, the cooling system according to the invention can be realized with a reduced number of components and little risk of oil leakage.

As described above in detail, according to the invention, the oil grooves formed in the top deck of the cylinder block in order to cool the tops and the neighboring areas of the cylinder liners of a multi-cylinder engine are interconnected in series and engine oil is made to flow through them. Thus, even if the cross sectional areas of the oil grooves and those of the communication holes vary, engine oil flows through all the oil grooves at the same rate to prevent any problems due to disparity in the cooling capacity in the oil grooves.

Since the communication holes for connecting the adjacent oil grooves in series, the supply channel and inflow hole for supplying engine oil to the oil grooves and the outflow hole and return channel for discharging engine oil out of the oil grooves are all formed in the cylinder block, it is no longer necessary to use external pipes for circulating the engine oil. Therefore, the overall number of components can be reduced to consequently reduce the manufacturing cost. At the same time, it is no longer necessary to worry about oil leakage from connections of the pipes and hence the reliability of the cooling system is enhanced.

What is claimed is:

1. A cooling system for a multi-cylinder engine having a plurality of cylinders comprising:

a cylinder block having a plurality of cylinder liners and plurality of oil grooves each arranged in a top deck of said cylinder block to respectively surround said cylinder liners, said plurality of oil groves being arranged in series and being interconnecting in series, a plurality of supply and return channels formed in the cylinder block and being connectable to an oil pump and an oil pan, respectively, a plurality of communication holes formed in said cylinder block for interconnecting adjacent grooves of said plurality of oil grooves in series and said cylinder block having inflow and outflow holes formed therein for connecting the most upstream and downstream oil grooves of said plurality of oil grooves to the supply and return channels, respectively, wherein engine oil is communicable through the oil grooves in series during operation of the engine for effectively cooling a top portion of each of the cylinder liners and a neighboring area thereof.

* * * * *